US006240895B1

(12) United States Patent
Oder

(10) Patent No.: US 6,240,895 B1
(45) Date of Patent: Jun. 5, 2001

(54) METHOD FOR OPERATING AN INTERNAL COMBUSTION ENGINE MAINLY INTENDED FOR A MOTOR VEHICLE

(75) Inventor: Michael Oder, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,479

(22) PCT Filed: Mar. 22, 1999

(86) PCT No.: PCT/DE99/00822

§ 371 Date: Feb. 17, 2000

§ 102(e) Date: Feb. 17, 2000

(87) PCT Pub. No.: WO99/49197

PCT Pub. Date: Sep. 30, 1999

(30) Foreign Application Priority Data

Mar. 26, 1998 (DE) ..... 198 13 381

(51) Int. Cl.[7] ..... F02D 41/30
(52) U.S. Cl. ..... 123/295; 123/430
(58) Field of Search ..... 123/295, 299, 123/300, 430, 305

(56) References Cited

U.S. PATENT DOCUMENTS 5,755,198 * 5/1998 Grob et al. ..... 123/295
5,937,822 * 8/1999 Nakajima ..... 123/295
5,979,396 * 11/1999 Yasuoka ..... 123/295
6,050,238 * 4/2000 Suzuki et al. ..... 123/295
6,058,906 * 5/2000 Yoshino ..... 123/295
6,089,206 * 7/2000 Suzuki et al. ..... 123/295
6,092,507 * 7/2000 Bauer et al. ..... 123/430

FOREIGN PATENT DOCUMENTS 196 31 986 2/1998 (DE) .
0 829 631 3/1998 (EP) .
197 37 375 3/1998 (DE) .
0 849 457 6/1998 (EP) .
0 882 877 12/1998 (EP) .
4-362221 12/1992 (JP) .

* cited by examiner

*Primary Examiner*—Henry C. Yuen
*Assistant Examiner*—Hieu T. Vo
(74) *Attorney, Agent, or Firm*—Kenyon & Kenyon

(57) ABSTRACT

An internal combustion engine , particularly for a motor vehicle, which is provided with an injector (8) with the assistance of which fuel can be injected directly into a combustion chamber either in a first operating mode, during an induction period, or in a second operating mode, during a compression period. Furthermore, a control unit is provided for determining the air mass supplied to the combustion chamber , and for differently controlling and/or regulating the fuel mass injected into the combustion chamber in both operating modes. The control unit switches over between the first operating mode and the second operating mode as a function of the air mass supplied to the combustion chamber.

13 Claims, 5 Drawing Sheets

METHOD FOR OPERATING AN INTERNAL COMBUSTION ENGINE MAINLY INTENDED FOR A MOTOR VEHICLE

FIELD OF THE INVENTION

The present invention relates to a method for operating an internal combustion engine, particularly of a motor vehicle, where fuel is injected directly into a combustion chamber either in a first operating mode, during a compression period, or in a second operating mode, during an induction period; where the air mass supplied to the combustion chamber is ascertained; and where the fuel mass injected into the combustion chamber is controlled and/or regulated differently in the two operating modes. Furthermore, the present invention relates to an internal combustion engine, particularly for a motor vehicle, having an injector with the assistance of which fuel can be injected directly into a combustion chamber either in a first operating mode, during an induction period or, in a second operating mode, during a compression period, and having a control unit for ascertaining the air mass supplied to the combustion chamber, and for differently controlling and/or regulating the fuel mass injected into the combustion chamber in both operating modes.

BACKGROUND INFORMATION

Such systems for injecting fuel directly into the combustion chamber of an internal combustion engine are generally known. In this context, a distinction is made between a so-called "stratified operation" as a first operating mode and a so-called "homogeneous operation" as a second operating mode. The stratified operation is used particularly in the case of smaller loads while the homogeneous operation is used in the case of bigger loads placed on the internal combustion engine.

In the stratified operation, fuel is injected into the combustion chamber during the compression period of the internal combustion engine in such a manner that, at the time of ignition, a fuel cloud is in the immediate surroundings of a spark plug. This injection can be carried out in different ways. In fact, is possible for the injected fuel cloud to be near the spark plug during or immediately after the injection, and to be ignited by the spark plug. It is also possible for the injected fuel cloud to be conveyed to the spark plug by a charging movement, and to be ignited only then. In both burning methods, there is no uniform fuel distribution but a stratified charge.

The advantage of the stratified operation is that it makes it possible for the placed smaller loads to be executed by the internal combustion engine using a very small fuel quantity. Bigger loads, however, cannot be fulfilled by the stratified operation.

In the homogeneous operation intended for such bigger loads, fuel is injected during the induction period of the internal combustion engine, so that the fuel can still be swirled, and thus distributed in the combustion chamber without any problem. In this respect, the homogeneous operation corresponds more or less to the operating mode of internal combustion engines where fuel is injected into the intake pipe in a conventional manner. If required, the homogeneous operation can also be used for smaller loads.

In the stratified operation, the throttle valve in the intake pipe leading to the combustion chamber is wide opened, and the combustion is mainly controlled and/or regulated via the fuel mass to be injected. In the homogeneous operation, the throttle valve is opened or closed as a function of the required torque, and the fuel mass to be injected is controlled and/or regulated as a function of the air mass taken in.

In both operating modes, i.e., in the stratified operation and the homogeneous operation, the fuel mass to be injected is controlled and/or regulated additionally as a function of a plurality of further input variables to an optimal value in terms of fuel saving, exhaust reduction and the like. In this context, the control and/or regulation is different in the two operating modes.

It is required to switch over the internal combustion engine from the stratified operation to the homogeneous operation and back again. While in the stratified operation, the throttle valve is opened wide, and the air is consequently supplied in a substantially dethrottled manner, in the homogeneous operation, the throttle valve is opened only partially, thus reducing the supply of air. In this context, above all during the switchover from the stratified operation to the homogeneous operation, the capability of the intake pipe leading to the combustion chamber of storing air must be taken into account. If this is not taken into account, the switchover may lead to an increase in the torque delivered by the internal combustion engine.

SUMMARY OF THE INVENTION

The object of the present invention is to devise a method for operating an internal combustion engine which makes it possible to optimally switch over between the operating modes.

This objective is achieved according to the present invention by switching over between the first operating mode and the second operating mode as a function of the air mass supplied to the combustion chamber.

The air mass supplied to the combustion chamber represents an exact and reliable criterion on the basis of which the switchover operation from the first to the second operating mode, or from the second to the first operating mode can be carried out. Furthermore, the air mass supplied to the combustion chamber can be determined either by the control unit with the assistance of model calculations, or a pressure sensor or air-mass flow sensor that is present in the intake pipe for determining the air mass supplied to the combustion chamber. In this context, both ways can be implemented in a simple manner, and with little constructional outlay.

In an advantageous embodiment of the present invention, a switchover is made from the first to the second operating mode when the air mass supplied to the combustion chamber falls below a maximum air mass for the homogeneous operation. During the switchover from the stratified operation to the homogeneous operation, the air mass supplied to the combustion chamber decreases. If the air mass reaches the specified maximum value for the homogeneous operation, then a switchover is made to the homogeneous operation. Consequently, this transition can be controlled and carried out in a simple manner.

It is particularly advantageous to reduce the supply of the air mass to the combustion chamber prior to switching over to the second operating mode. This is achieved by closing the throttle valve prior to the actual switchover.

In a further advantageous embodiment of the present invention, the supplied fuel-air mixture is controlled and/or regulated to a predetermined, in particular a stoichiometric value in the second operating mode. Thus, the fuel-air mixture has a defined, predetermined value, for example 1. In this manner, a particularly low-emission operation of the internal combustion engine is achieved.

In this context, it is particularly expedient for the fuel mass to be injected to be determined from the supplied air mass subsequent to switching over to the second operating mode. In this manner, it can be guaranteed that the predetermined or stoichiometric value of the fuel-air mixture is maintained.

Moreover, it is particularly expedient for the ignition-advance angle to be determined from the required torque subsequent to switching over to the second operating mode. Thus, with the assistance of the ignition-advance angle, it is possible to achieve, in particular short-term changes in torque without having to change the predetermined or stoichiometric value.

In an advantageous embodiment of the present invention, a switchover is made from the second to the first operating mode when the air mass supplied to the combustion chamber exceeds a minimum air mass for the stratified operation. During the switchover from the homogeneous operation to the stratified operation, the air mass supplied to the combustion chamber increases. If the air mass reaches the specified minimum value for the stratified operation, then a switchover is made to the stratified operation. Consequently, this transition can be controlled and carried out in a simple manner.

It is particularly advantageous to increase the supply of the air mass to the combustion chamber prior to switching over to the first operating mode. This is achieved by opening the throttle valve prior to the switchover.

It is particularly expedient to increase the fuel mass to be injected prior to switching over to the first operating mode.

Furthermore, it is particularly expedient to retard the ignition prior to switching over to the first operating mode.

Of particular importance is the implementation of the method according to the present invention in the form of a control element designed for a control unit of an internal combustion engine, particularly of a motor vehicle. In this context, a program is stored on the control element which can be executed on a computing element, in particular on a microprocessor, and is suitable for carrying out the method according to the present invention. In this case, consequently, the present invention is implemented by a program stored on the control element so that this control element provided with the program represents the present invention in the same way as the method for whose execution the program is suitable. As control element, particularly an electric storage medium can be used, for example, a read-only memory.

Further features, uses and advantages of the present invention ensue from the following description of exemplary embodiments of the invention which are shown in the figures of the drawing. In this context, all described or represented features alone or in arbitrary combination constitute the subject matter of the present invention, independently of their composition in the patent claims, or the relating back of the patent claims, and independently of their formulation or representation in the description or in the drawing.

DETAILED DESCRIPTION.

Figure 1:
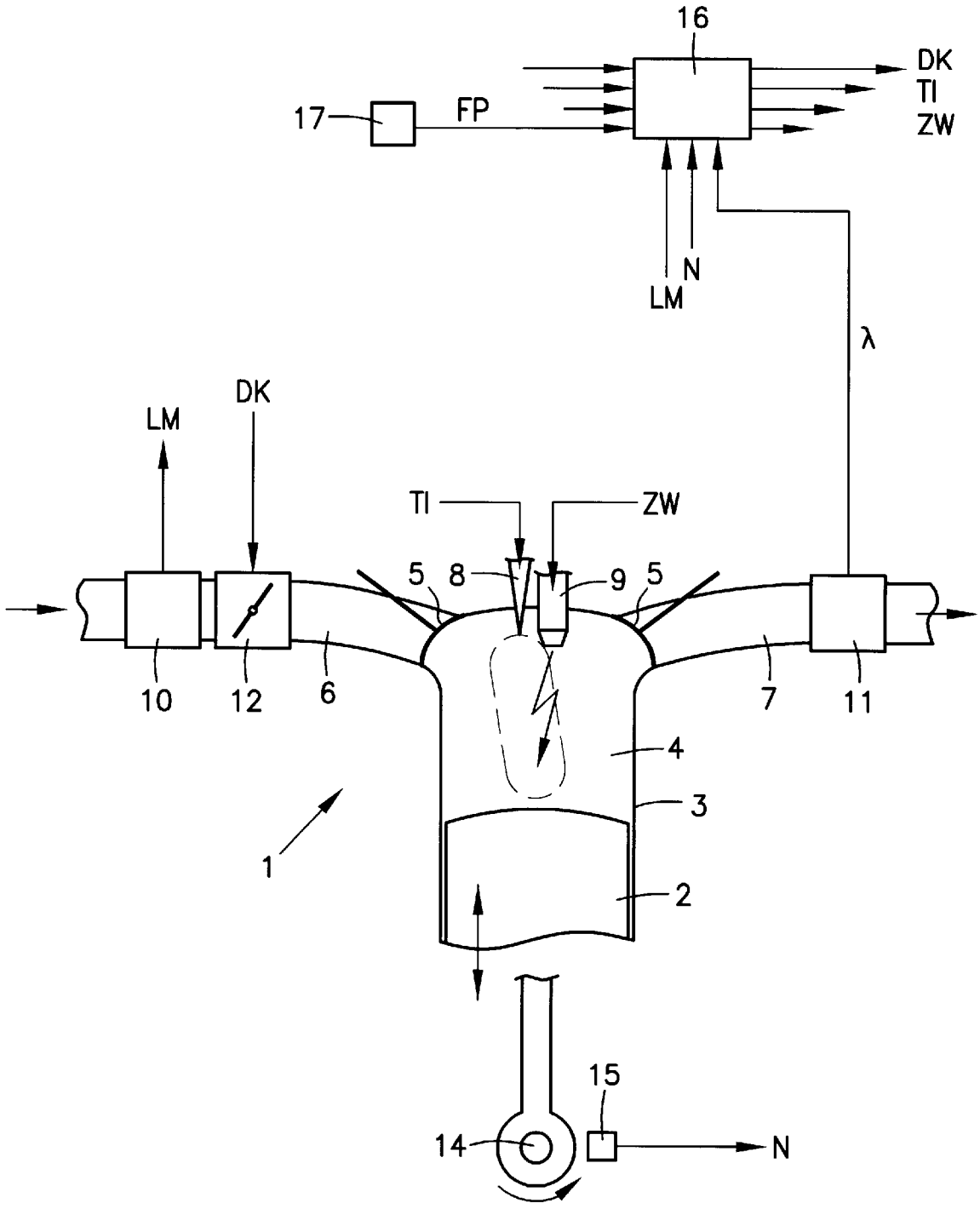
FIG. 1 shows a block diagram of an embodiment of an internal combustion engine of a motor vehicle according to the present invention.

FIG. 1 shows an internal combustion engine 1, where a piston 2 can be moved back and forth in a cylinder 3. Cylinder 3 is provided with a combustion chamber 4, to which an intake pipe 6 and an exhaust pipe 7 are connected via valves 5. Moreover, an injector 8 capable of being controlled via a signal TI and a spark plug 9 capable of being controlled via a signal ZW are allocated to combustion chamber 4.

Intake pipe 6 is provided with an air-mass flow sensor 10, and exhaust pipe 7 may be provided with a lambda sensor 11. Air-mass flow sensor 10 measures the air mass of the fresh air supplied to intake pipe 6 and generates a signal LM as a function thereof. Lambda sensor 11 measures the oxygen content of the exhaust gas in exhaust pipe 7 and generates a signal $\lambda$ as a function thereof.

Placed in intake pipe 6 is a throttle valve 12 whose rotational position can be adjusted with the assistance of a signal DK.

In a first operating mode, the stratified operation of internal combustion engine 1, throttle valve 12 is opened wide. During a compression period caused by piston 2, fuel is injected into combustion chamber 4 by injector 8, to be more precise, in terms of location, in the immediate surroundings of spark plug 9, and, in terms of time, at an appropriate distance prior to the ignition firing point. Then, the fuel is ignited with the assistance of spark plug 9 so that, during the now following power stroke, piston 2 is driven by the expansion of the ignited fuel.

In a second operating mode, the homogeneous operation of internal combustion engine 1, throttle valve 12 is partially opened or closed as a function of the desired supplied air mass. During a induction period caused by piston 2, fuel is injected into combustion chamber 4 by injector 8. By the air taken in concurrently, the injected fuel is swirled and thus distributed in combustion chamber 4 in an essentially uniform manner. Subsequently, during the compression period, the fuel-air mixture is compressed, and then ignited by spark plug 9. Piston 2 is driven by the expansion of the ignited fuel.

Both in the stratified operation and in the homogeneous operation, the driven piston sets a crankshaft 14 into rotary motion, via which, in the end, the wheels of the motor vehicle are driven. Allocated to crankshaft 14 is an RPM sensor 15 that generates a signal N as a function of the rotary motion of crankshaft 14.

The fuel mass injected into combustion chamber 4 by injector 8 during the stratified operation and during the homogeneous operation is controlled and/or regulated by a control unit 16 with regard to a low fuel consumption and/or a low pollutant development. To this end, control unit 16 is provided with a microprocessor that has a program stored in a storage medium, particularly in a read-only memory. The program is suitable for carrying out the indicated control and/or regulation.

Control unit 16 receives input signals that represent performance quantities measured with the assistance of sensors. For example, control unit 16 is connected to air-mass flow sensor 10, lambda sensor 11, and RPM sensor 15. Furthermore, control unit 16 is connected to an accelerator sensor 17, which generates a signal FP indicating the position of an accelerator capable of being actuated by a driver.

Control unit 16 generates output signals to influence the behavior of the internal combustion engine via actuators according to the desired control and/or regulation. For example, control unit 16 is connected to injector 8, spark plug 9, and throttle valve 12, and generates signals TI, ZW, and DK, required for the control thereof.

Figure 2A:
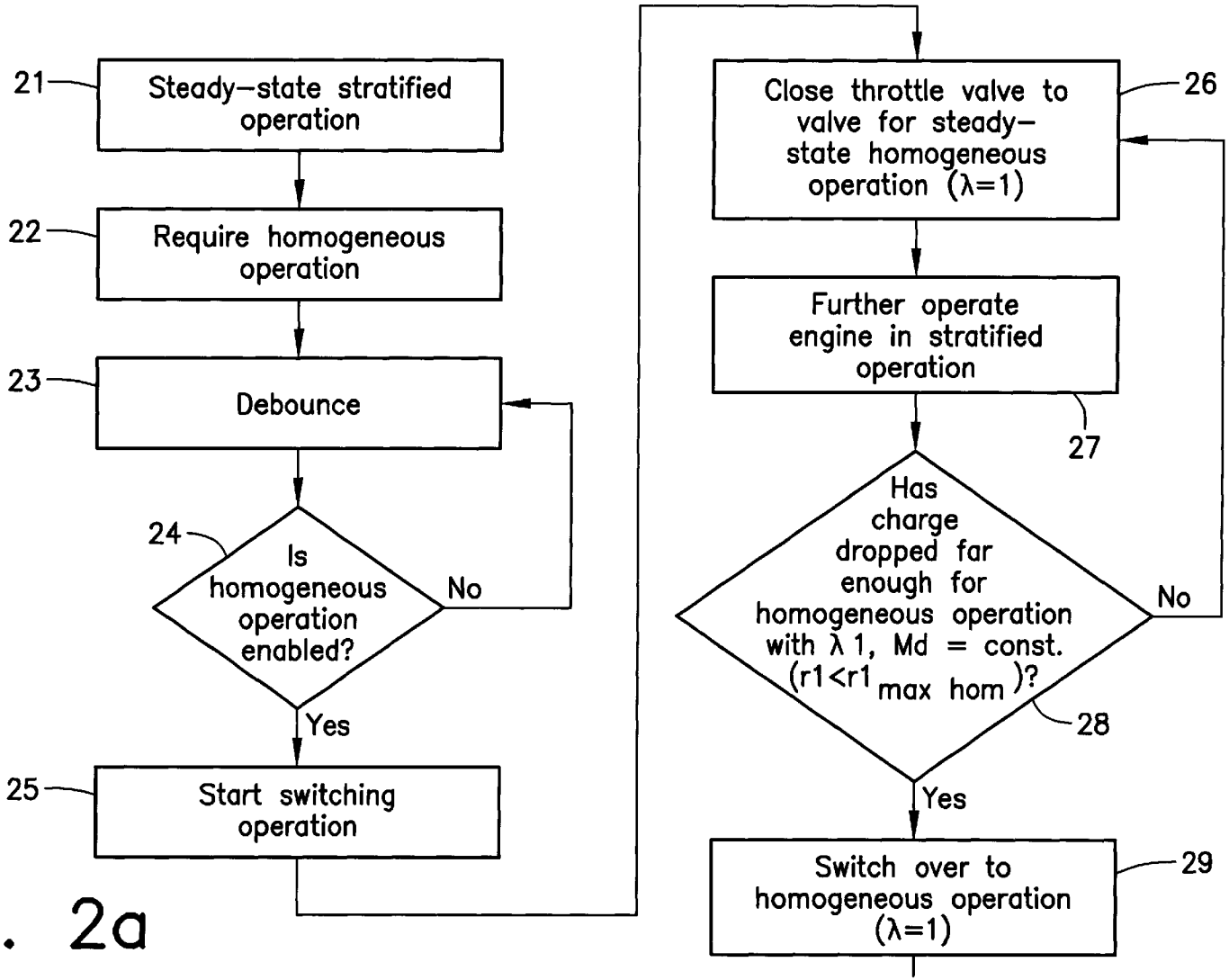
FIG. 2 shows a flow chart of an embodiment of a method according to the present invention for operating the internal combustion engine shown in FIG. 1.
Figure 2B:
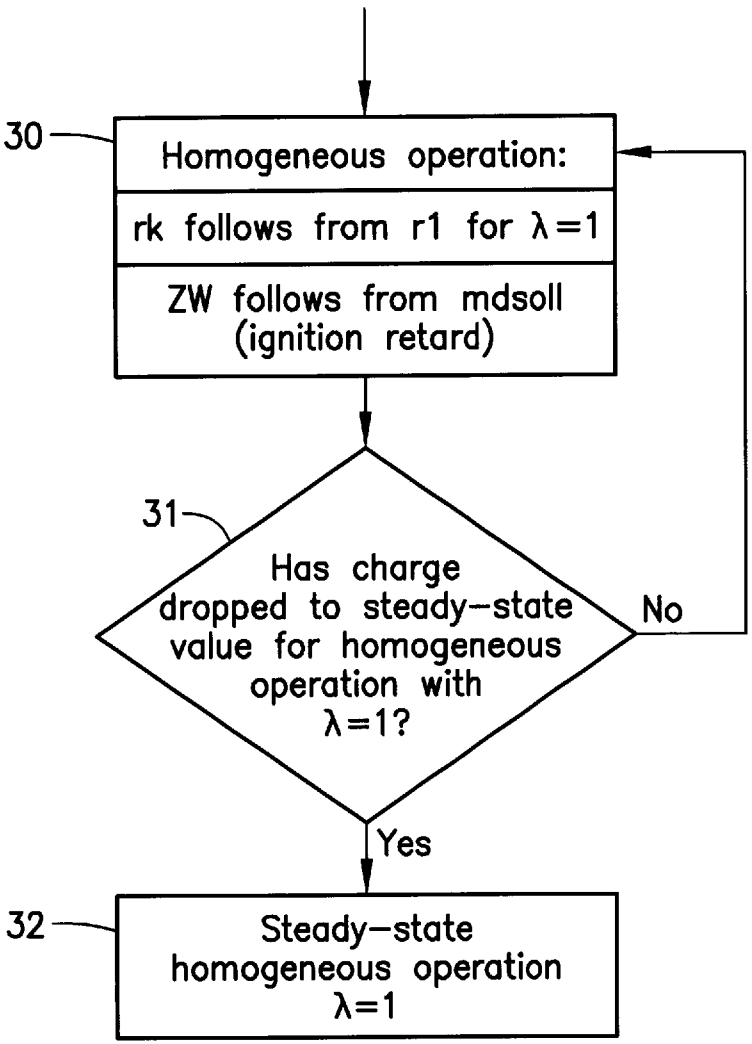
Figure 3:
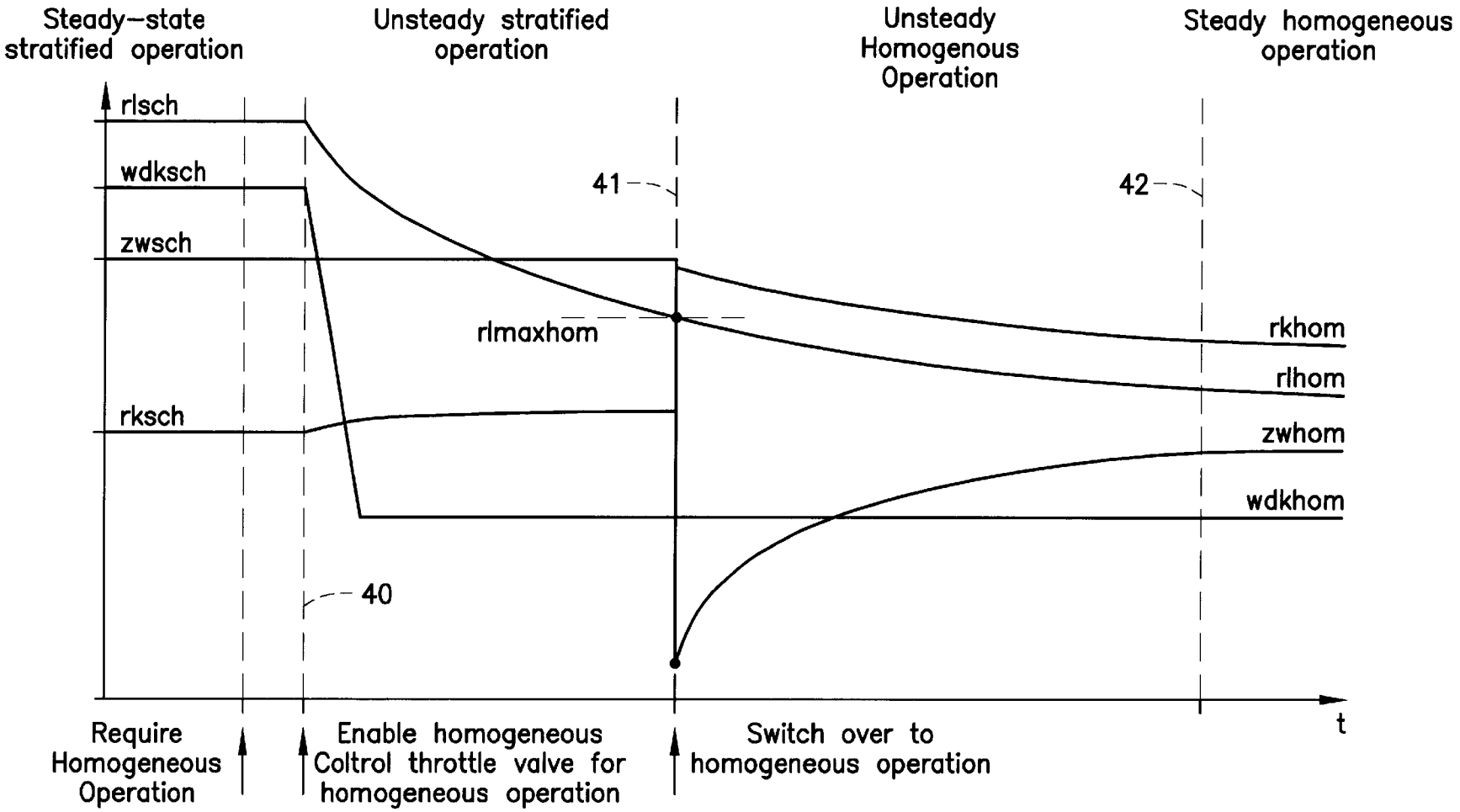
FIG. 3 shows a schematic timing diagram of signals of the internal combustion engine shown in FIG. 1 when carrying out the method shown in FIG. 2.

Carried out by control unit 16 is the method for switching over from a statified charge operation to a homogeneous operation, described on the basis of FIGS. 2 and 3. In this context, the blocks shown in FIG. 2 represent functions of the method, which are implemented in control unit 16, for example, in the form of software modules or the like.

In FIG. 2, it is assumed that internal combustion engine 1 is in a steady-state stratified operation. In a block 22, a transition into a homogeneous operation is then required, for example, because the driver wishes to accelerate the motor vehicle. The instant of requiring the homogeneous operation can also be gathered from FIG. 3.

Subsequently, by blocks 23, 24, a debouncing is carried out, avoiding a switching back and forth between the statified charge and the homogeneous operation in quick succession. When the homogeneous operation is enabled, then the transition from the statified charge operation to the homogeneous operation is started by a block 25. In FIG. 3, the instant at which the switchover operation begins is referred to with reference numeral 40.

At indicated instant 40, throttle valve 12 is controlled from its completely opened condition wdksch during the statified charge operation into an at least partially opened or closed condition wdkhom for the homogeneous operation with the assistance of a block 26. In this context, the rotational position of throttle valve 12 in the homogeneous operation is oriented to a stoichiometric fuel-air mixture, i.e. to $\lambda=1$, and depends also on, for example, the required torque and/or the speed N of internal combustion engine 1 and the like.

By adjusting throttle valve 12, internal combustion engine 1 goes over from the steady-state stratified operation into an unsteady stratified operation. In this operating state, the air mass supplied to combustion chamber 4 decreases from a charge rlsch during the stratified operation to smaller charges. This can be gathered from FIG. 3. In this context, air mass rl supplied to combustion chamber 4, or rather, its charge is determined by control unit 16, inter alia, from signal LM of air-mass flow sensor 10. According to a block 27, the internal combustion engine 1 continues to be operated in the stratified operation.

In a block 28 of FIG. 2, it is checked whether the air mass supplied to combustion chamber 4 has reached a specific value, to be more precise, whether charge rl has fallen below a maximum air mass, or rather, maximum charge for the homogeneous operation rlmaxhom. Thus, it is checked whether rl<rlmaxhom. In this context, charge rlmaxhom is predetermined in such a way that the torque delivered by internal combustion engine 1 remains more or less constant with a $\lambda=1$.

If rl<rlmaxhom is not fulfilled, then it is continued to wait in a loop via block 26. If this is the case, however, which is given in FIG. 3 at an instant referred to with reference numeral 41, then at this instant, a switchover is made from the unsteady stratified operation to an unsteady homogeneous operation. In this context, according to FIG. 2, the switchover is carried out with the assistance of a block 29. The fuel-air mixture continues to be maintained at $\lambda=1$.

According to a block 30, fuel mass rk injected into combustion chamber 4 during the homogeneous operation is controlled and/or regulated as a function of air mass rl supplied to combustion chamber 4 in such a manner that a stoichiometric fuel-air mixture is formed, i.e., that $\lambda=1$.

Fuel mass rk influenced in this manner results in that, at least during a certain period of time, the torque Md delivered by internal combustion engine 1 would increase. This is compensated by adjusting ignition-advance angle ZW, starting from value zwsch, at the instant 41, i.e., when switching over to the homogeneous operation, in such a manner that delivered torque Md retains value mdsoll, and consequently remains more or less constant.

This is achieved in FIG. 2 via a block 30. There, fuel mass rk is determined from air mass rl supplied to combustion chamber 4, taking a stoichiometric fuel-air mixture as a basis. Furthermore, ignition-advance angle ZW is adjusted in the direction of an ignition retard as a function of torque mdsoll to be delivered. Therefore, with regard to this ignition retard, a certain deviation from the normal homogenous operation is still present, this deviation being used to temporarily annihilate the air mass which is still supplied in excess as well as the resulting torque of internal combustion engine 1 which is generated in excess.

In a block 31, it is checked whether charge rl supplied to combustion chamber 4 has finally fallen to the charge appertaining to a steady-state homogeneous operation at a stoichiometric fuel-air mixture. If this is not the case yet, then it is continued to wait in a loop via block 30. If this is the case, however, then internal combustion engine 1 continues to be operated in the steady-state homogeneous operation with the assistance of block 32 without adjusting the ignition-advance angle. In FIG. 3, this is the case at an instant referred to with reference numeral 42.

During this steady-state homogeneous operation, the air mass supplied to combustion chamber 4 corresponds to charge rlhom for the homogeneous operation, and ignition-advance angle zwhom for spark plug 9 also corresponds to that for the homogeneous operation. The equivalent applies to rotational position wdkhom of throttle valve 12.

Figure 4:
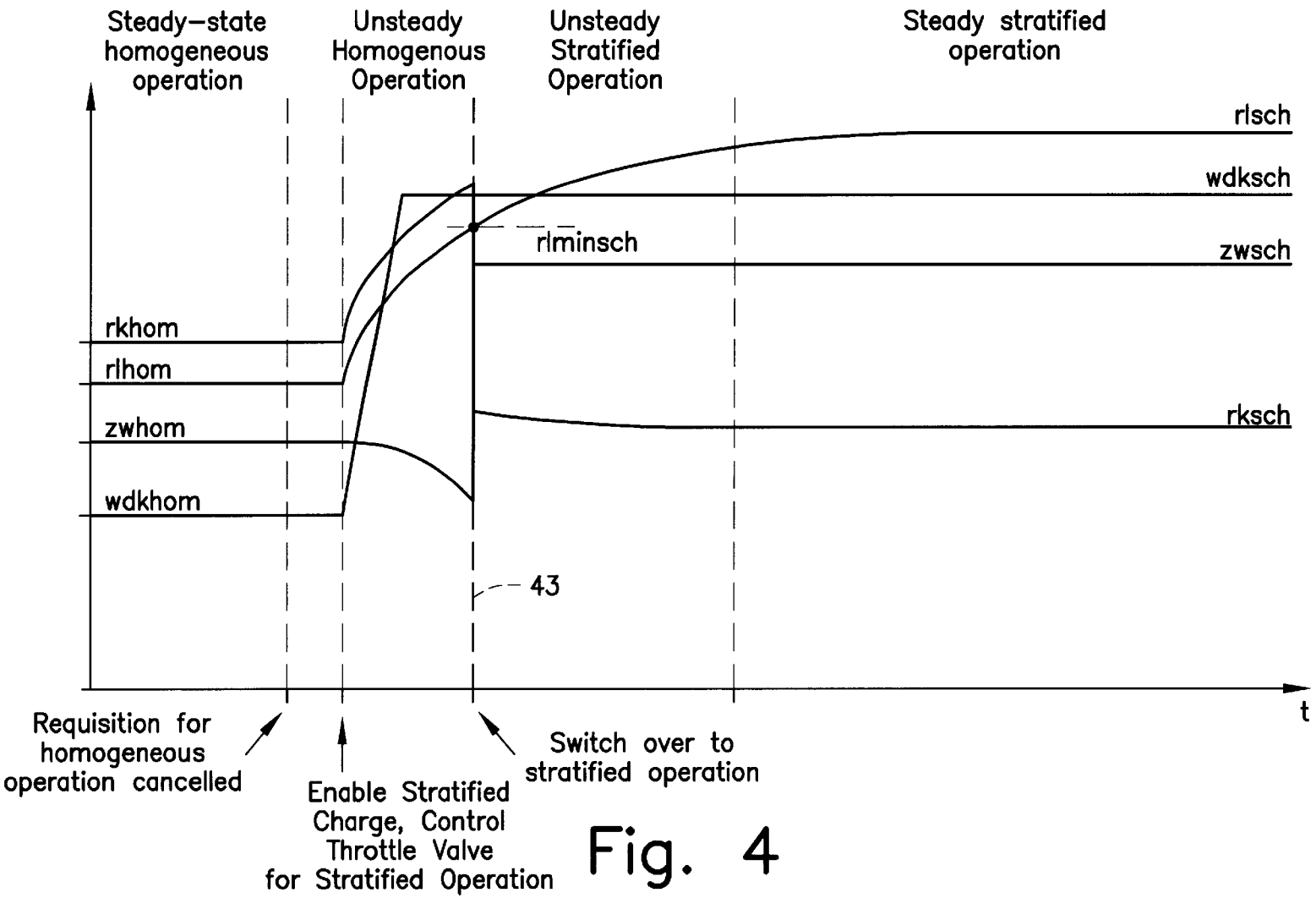
FIG. 4 shows a schematic timing diagram of signals of the internal combustion engine shown in FIG. 1 when carrying out a method contrary to the method shown in FIG. 2.

FIG. 4 shows a switchover from a homogeneous operation to a stratified operation. In this context, it is started from a steady-state homogeneous operation in which it is intended to go over to a steady-state stratified operation, for example, because of the performance quantities of internal combustion engine 1.

The switchover to the stratified operation is initiated by control unit 16 by canceling the requisition for the homogeneous operation. Subsequent to a debouncing, the switchover to the stratified operation is enabled, and throttle valve 12 is controlled into the rotational position which is intended for the stratified operation. This is a rotational position in which throttle valve 12 is largely opened. This is shown in FIG. 4 by the transition from wdkhom to wdksch.

Opening throttle valve 12 results in an increase in air mass rl supplied to combustion chamber 4. In FIG. 4, this can be gathered from the curve of rlhom. If air mass rl exceeds a minimum value for the stratified operation rlminsch, then the switchover from the homogeneous operation to the stratified operation takes place. In FIG. 4, this is the case at instant 43.

Prior to switching over to the stratified operation, the increasing air mass supplied to combustion chamber 4 is compensated by increasing injected fuel mass rk and retarding ignition-advance angle ZW. This follows in FIG. 4 from the curves of rkhom and zwhom.

Subsequent to switching over to the stratified operation, injected fuel mass rk is adjusted to value rksch for the stratified operation. The equivalent applies to ignition-advance angle ZW, which is adjusted to value zwsch for the stratified operation.

What is claimed is:

1. An internal combustion engine for a motor vehicle, comprising:

a fuel injector directly injecting a fuel mass into a combustion chamber in one of a first operating mode and a second operating mode, the first operating mode occurring during a compression period, the second operating mode occurring during an induction period; and a control unit determining an air mass supplied to the combustion chamber and at least one of controlling and regulating the fuel mass injected into the combustion chamber differently in the first operating mode and the second operating mode, the control unit implementing a switchover between the first operating mode and the second operating mode as a function of the air mass supplied to the combustion chamber.

2. A control element for a control unit of an internal combustion engine of a motor vehicle, comprising:

a read-only memory storing a program executable in a microprocessor to perform the following:

inject a fuel mass directly into a combustion chamber in one of a first operating mode and a second operating mode, the first operating mode occurring during a compression period, the second operating mode occurring during an induction period;

determine an air mass supplied to the combustion chamber;

at least one of control and regulate the fuel mass injected into the combustion chamber differently in the first operating mode and the second operating mode; and switch over between the first operating mode and the second operating mode as a function of the air mass supplied to the combustion chamber.

3. A method for operating an internal combustion engine of a motor vehicle, comprising the steps of:

injecting a fuel mass directly into a combustion chamber in one of a first operating mode and a second operating mode, the first operating mode occurring during a compression period, the second operating mode occurring during an induction period;

determining an air mass supplied to the combustion chamber;

at least one of controlling and regulating the fuel mass injected into the combustion chamber differently in the first operating mode and the second operating mode; and switching over between the first operating mode and the second operating mode as a function of the air mass supplied to the combustion chamber.

4. The method according to claim 3, wherein the step of switching occurs when the air mass falls below a maximum air mass for a homogenous operation.

5. The method according to claim 4, further comprising the step of:

reducing the air mass supplied to the combustion chamber prior t6 the'step of switching to the second operating mode.

6. The method according to claim 3, further comprising the step of:

at least one of controlling and regulating a supplied fuel-air mixture to a predetermined stoichiometric value in the second operating mode.

7. The method according to claim 6, further comprising the step of:

determining the fuel mass from the air mass subsequent to the step of switching over to the second operating mode.

8. The method according to claim 6, further comprising the step of:

determining an ignition-advance angle from a required torque subsequent to the step of switching over to the second operating mode.

9. The method according to claim 8, further comprising the step of:

retarding the ignition-advance angle.

10. The method according to claim 3, further comprising the step of:

switching over from the second operating mode to the first operating mode when the air mass exceeds a minimum air mass for a stratified operation.

11. The method according to claim 10, comprising the step of:

increasing the air mass prior to the step of switching over to the first operating mode.

12. The method according to claim 10, comprising the step of:

increasing the fuel mass prior to the step of switching over to the first operating mode.

13. The method according to claim 10, wherein the step of retarding occurs prior to the step of switching over to the first operating mode.

* * * * *